US010760318B2

(12) United States Patent
Fortmann et al.

(10) Patent No.: US 10,760,318 B2
(45) Date of Patent: Sep. 1, 2020

(54) PNEUMATIC CONTROL SYSTEM

(71) Applicant: Aventics GmbH, Laatzen (DE)

(72) Inventors: Norbert Fortmann, Hannover (DE); Tim Warning, Lehrte (DE); Florent Orget, Hannover (DE)

(73) Assignee: Aventics GmbH (DE)

( * ) Notice: Subject to any disclaimer, the term of this patent is extended or adjusted under 35 U.S.C. 154(b) by 0 days.

(21) Appl. No.: 16/329,725

(22) PCT Filed: Aug. 21, 2017

(86) PCT No.: PCT/DE2017/000255

§ 371 (c)(1),
(2) Date: Feb. 28, 2019

(87) PCT Pub. No.: WO2018/041284

PCT Pub. Date: Mar. 8, 2018

(65) Prior Publication Data

US 2019/0194998 A1 Jun. 27, 2019

(30) Foreign Application Priority Data

Aug. 31, 2016 (DE) ..... 10 2016 010 481

(51) Int. Cl.
*E05F 15/50* (2015.01)
*F15B 20/00* (2006.01)

(52) U.S. Cl.
CPC ..... *E05F 15/50* (2015.01); *F15B 20/004* (2013.01); *E05Y 2800/11* (2013.01);
(Continued)

(58) Field of Classification Search
CPC ..... F15B 20/04; F15B 2211/30575; F15B 2211/3057; E05F 15/50; E05Y 2800/11; E05Y 2800/15
(Continued)

(56) References Cited

U.S. PATENT DOCUMENTS 6,978,818 B1 * 12/2005 Vicktorius ..... B65C 9/26 156/556
2019/0017520 A1 * 1/2019 Fallahi ..... F15B 9/09

FOREIGN PATENT DOCUMENTS

DE 32 25 536 A1 1/1984
DE 34 20 631 A1 12/1985
(Continued)

OTHER PUBLICATIONS

International Search Report corresponding to PCT Application No. PCT/DE2017/000255, dated Jan. 3, 2018; (German and English language document) (5 pages).

*Primary Examiner* — Michael Leslie
*Assistant Examiner* — Daniel S Collins
(74) *Attorney, Agent, or Firm* — Maginot, Moore & Beck LLP; David Moorman

(57) ABSTRACT

The disclosure relates to a pneumatic control system for a working cylinder, which pneumatic control system enables resistance-free manual motion of the device driven by the working cylinder in the event of a failure or switch-off of the compressed air supply and is independent of electrical supply. The problem is solved by means of a pneumatic control system having a double-acting working cylinder, the two chambers of which can be connected oppositely to a compressed air source and a compressed air outlet by means of a controllable supply device having two operating positions, an independently resetting 3/2-way valve switchable by means of a control pressure being arranged before each chamber in a connecting line to the supply device, which 3/2-way valves connect the chambers to bleeding outlets in a first switching position and to the supply device in a second switching position, and a parallel circuit of a check valve and a throttle point being arranged before each chamber, the check valves of which parallel circuits block in the backflow direction, wherein the two 3/2-way valves assume
(Continued)

the first switching position in the idle position and can be switched by means of a common control line, which is connected to both connecting lines to the supply device downstream of the 3/2-way valves by means of a change-over valve, and the parallel circuits are arranged in the connecting lines downstream of the respective 3/2-way valves.

7 Claims, 1 Drawing Sheet

(52) U.S. Cl.
CPC ..... *E05Y 2800/25* (2013.01); *E05Y 2900/51* (2013.01); *F15B 2211/3057* (2013.01); *F15B 2211/30565* (2013.01); *F15B 2211/40584* (2013.01); *F15B 2211/41527* (2013.01); *F15B 2211/7053* (2013.01); *F15B 2211/8752* (2013.01); *F15B 2211/8855* (2013.01); *F15B 2211/895* (2013.01)

(58) Field of Classification Search
USPC ..... 60/403
See application file for complete search history.

(56) References Cited

FOREIGN PATENT DOCUMENTS

| | | | |
|---|---|---|---|
| DE | 196 45 701 | A1 | 5/1998 |
| DE | 10 2006 049 491 | A1 | 4/2008 |
| DE | 10 2008 011 315 | A1 | 9/2009 |
| DE | 10 2011 001 003 | A1 | 9/2012 |

* cited by examiner

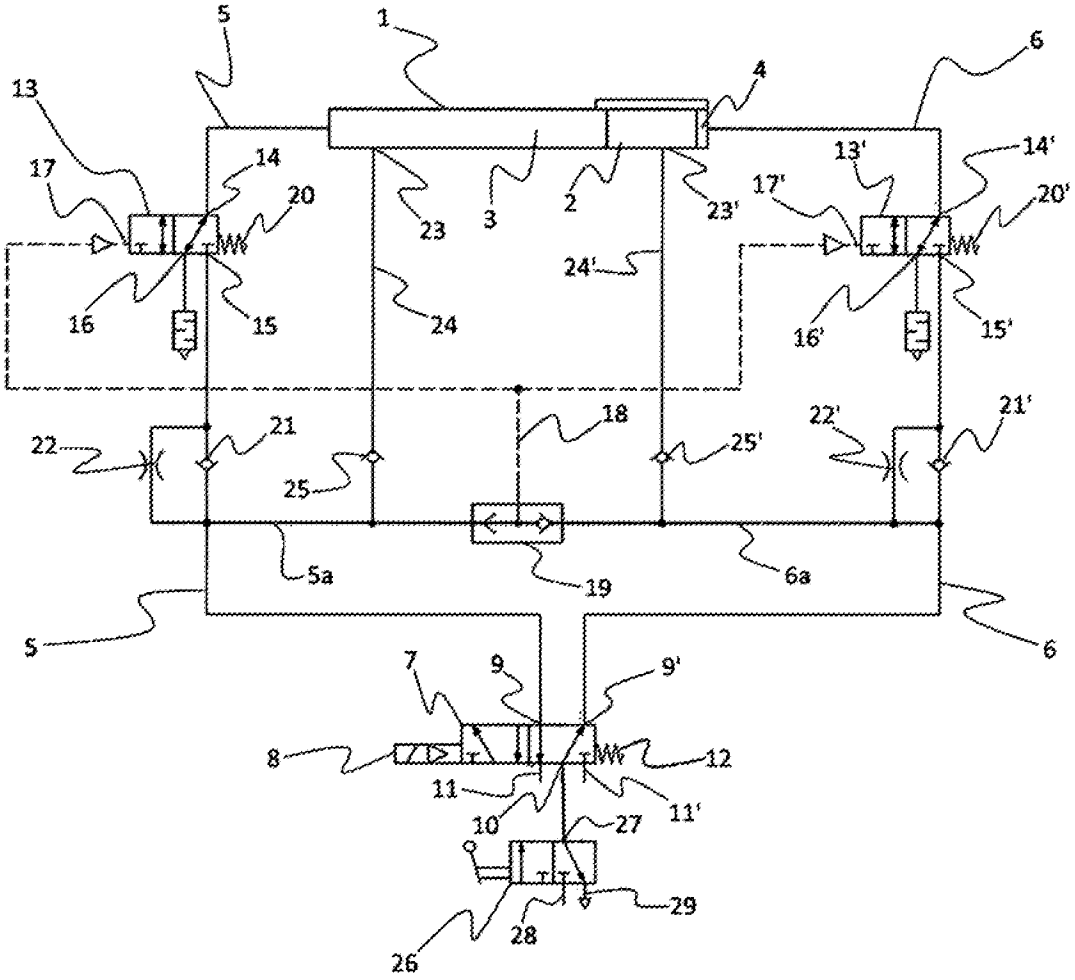
1
2
3
4
5
5a
6
6a
7
8
9
9'
10
11
11'
12
13
13'
14
14'
15
15'
16
16'
17
17'
18
19
20
20'
21
21'
22
22'
23
23'
24
24'
25
25'
26
27
28
29

PNEUMATIC CONTROL SYSTEM

This application is a 35 U.S.C. § 371 National Stage Application of PCT/EP2017/000255, filed on Aug. 21, 2017, which claims the benefit of priority to Serial No. DE 10 2016 010 481.3, filed on Aug. 31, 2016 in Germany, the disclosures of which are incorporated herein by reference in their entirety.

The disclosure relates to a pneumatic control system for a working cylinder which can be used, for example, for controlling the opening and closing of the doors of vehicles used for transporting persons, such as busses, trams or trains.

BACKGROUND

For controlling vehicle doors in the field of public passenger transport, for example, in busses, trams or trains, the use of pneumatic or electropneumatic control systems is known. The control system contains as a drive one or more pneumatic working elements with pressure chambers for producing an opening and/or closing force for the vehicle door. Generally, two pressure chambers, an opening chamber and a closing chamber, are associated with the vehicle door. In this instance, it is possible to use as a drive, for example, a dual-action working or actuation cylinder. In order to open or close the doors, the respective pressure chamber of the working or actuation cylinder is acted on with pressure and the other chamber is ventilated in each case. Technical considerations of operational safety and legal regulations require at the same time the possibility of manual capacity for emergency operation of the vehicle doors in the event of malfunctions.

DE 32 25 536 A1 discloses a pneumatic vehicle door control system with a dual-action working cylinder and an electropneumatic control device whose chambers can be connected by means of upstream electrically switchable 3/2-way solenoid valves in each case in an opposing manner to a compressed air source or ventilation outlets of the 3/2-way solenoid valves. The 3/2-way solenoid valve arranged upstream of the opening chamber can be switched by means of a manually operable emergency tap, shuttle valve and an additional chamber which can be aerated by the compressed air source from the aeration position into the ventilation position. For complete ventilation of the system, the other 3/2-way solenoid valve can if necessary at the same time be electrically switched into the ventilation state. The pneumatic control system disclosed in DE 32 25 536 A1 further provides for electrical safety circuits of the 3/2-way solenoid valves in accordance with the differential pressure principle if defined pressure values are exceeded at specific locations of the system as a result of operational malfunctions. The emergency shutdowns provided in accordance with DE 32 25 536 A1 require for complete ventilation of the system depending on the current operating state either an active switching of involved components by means of a hand-operable emergency tap or additionally by means of an electronic switching device. The control system does not consequently enable any complete independent ventilation of the working cylinder in the event of a failure or a shutdown of the compressed air source. Furthermore, a complete ventilation in the event of failure of the electrical supply is not ensured. In addition, the vehicle door control provided by DE 32 25 536 A1 is relatively complex as a result of the large number of provided emergency shutdown functions.

DE 34 20 631 A1 discloses a pneumatic vehicle door control with a dual-action working cylinder whose chambers can be connected by means of upstream 3/2-way valves in each case in an opposing manner to a compressed air source or ventilation outlets of the 3/2-way solenoid valves. The two 3/2-way valves can be switched by means of three different electromagnetically, pneumatically and mechanically controllable actuation devices. For emergency control, a third, electromagnetically switchable 3/2-way valve and a manually operable emergency tap are provided. The control of the electromagnetic actuation members is carried out by means of a central electronic switching device. The vehicle door control proposed by DE 34 20 631 A1 provides—in a manner comparable with DE 32 25 536 A1—several relatively complex emergency shutdown functions which can be activated by means of monitoring devices which are constructed as differential pressure switches or by means of manual activation using a switch or the emergency tap and therefore has the same disadvantages as the vehicle door control system known according to DE 32 25 536 A1.

DE 196 457 01 A1 discloses a pneumatic door control system having a dual-action working cylinder whose chambers can be connected by means of upstream pneumatically switchable 3/2-way solenoid valves in an opposing manner to a pressure medium inlet or a pressure medium outlet, wherein the switching of the two 3/2-way valves is carried out by means of three electrically switchable solenoid precontrol valves. The pneumatic door control provides for a safety switching state in which as a result of the actuation of one of the three solenoid precontrol valves both chambers of the working cylinder are connected by means of a corresponding identical positioning of the 3/2-way valves to the pressure medium inlet and are acted on at the same time, whereby an assumed position of the vehicle door is secured. The door control system disclosed by DE 196 457 01 does not provide for any simultaneous ventilation of both chambers of the working cylinder. Furthermore, a failure of the electrical supply leads to the failure of the control system, whereby the working cylinder remains in its current operating state.

DE 10 2008 011 315 A1 discloses a pneumatic vehicle door control system having a dual-action working cylinder whose chambers can be connected by means of upstream pneumatically switchable 3/2-way valves to a compressed air source, wherein the 3/2-way valves connect both chambers in an idle position to the compressed air source and the control pressure for one of the two 3/2-way valves is based on the pressure of the other chamber of the working cylinder. In one embodiment, the 3/2-way valves are resiliently pretensioned into the idle position. In order to prevent a sudden opening and closure of the doors, there are arranged upstream of the chambers of the working cylinder, upstream of the 3/2-way valves, parallel circuits comprising non-return valves which block the return flow and throttles which act as exhaust air throttles. The vehicle door control system disclosed by DE 10 2008 011 315 A1 does not provide for any manual capacity for emergency operation of the vehicle doors with a ventilation of the chambers of the working cylinder in the event of malfunctions.

DE 2011 001 003 A1 discloses a pneumatic vehicle door control with a dual-action working cylinder whose chambers can be connected by means of upstream electrically and manually controllable 3/2-way valves to a compressed air source, wherein the 3/2-way valves apply pressure to both chambers in a preferably spring-loaded idle position and secure the working cylinder in the position which it has assumed. The 3/2-way valves can be moved by means of electrically controllable actuators or by means of manual activation into a ventilation position, in which the chamber which is associated therewith in each case is ventilated, whereby an opening or closing of the vehicle doors is brought about. In order to prevent sudden opening and closing of the doors, there are arranged upstream of the chambers of the working cylinder, upstream of the 3/2-way valves, parallel circuits comprising non-return valves which block the return flow and throttles which act as exhaust air throttles. In the case of a drop in the electrical line supply, the control system according to DE 2011 001 003 A1 provides for a manual emergency activation of the vehicle doors by means of the manual movement of a hand-operated valve which is arranged downstream of the compressed air source into a ventilation position in which the system is separated from the compressed air source and is connected by means of a shuttle valve which is also activated by the hand-operated valve to a rapid ventilation, whereby both chambers are ventilated. The vehicle door control system which is provided in accordance with DE 2011 001 003 A1 requires for complete ventilation the operation of a hand-operated valve which potentially cannot be reached in every emergency situation. The control system further does not enable any complete independent ventilation of the working cylinder in the event of a failure or a shutdown of the compressed air source. Since the parallel circuits which act as an exhaust air throttle are arranged directly upstream of the chambers of the working cylinder, they also act during manual emergency operation, whereby an increased opening or closing resistance exists with manual emergency operation.

SUMMARY

An object of the disclosure is to avoid the disadvantages set out. In particular with a pneumatic control system which can be used to control vehicle doors, an independent complete emergency ventilation should be provided which, in the event of failure or shutdown of the compressed air supply, enables a resistance-free manual movement of a device driven by the working cylinder, for example, vehicle doors, and which is independent of an electrical supply.

The object is achieved according to the disclosure by a pneumatic control system according to claim 1, advantageous embodiments are described in the dependent claims.

The disclosure fundamentally comprises a pneumatic control system with a dual-action working cylinder whose two chambers can be connected by means of a controllable supply device having two operating positions in an opposing manner to a compressed air source and a compressed air outlet, and there is arranged upstream of each chamber in a connection line to the supply device in each case an independently returning 3/2-way valve which can be switched with a control pressure, which valves connect the chambers in a first switching position to ventilation outlets and connect them in a second switching position to the supply device, and there is arranged upstream of each chamber a parallel circuit comprising a non-return valve and a throttle location whose non-return valves block in the return flow direction, wherein the two 3/2-way valves in the idle position assume the first switching position and can be switched by means of a common control line which is connected downstream of the 3/2-way valves by means of a shuttle valve to the connection lines to the supply device and the parallel circuits are arranged in the connection lines in each case downstream of the 3/2-way valves. The supply device is connected by means of connection lines to the two chambers of the dual-action working cylinder. It connects the chambers of the dual-action working cylinder in two operating positions in each case in an opposing manner to a compressed air source and a compressed air outlet and consequently ensures depending on the operating position the application of pressure (ventilation) to one chamber and the simultaneous ventilation of the other chamber of the dual-action working cylinder in each case. With the opposing application and ventilation of the chambers in both operating positions alternating in each case, a device which is driven by the working cylinder can be moved with the respective movement direction of the piston stroke in two different directions, it is thus possible, for example, for vehicle doors driven by the working cylinder to carry out a closing and opening movement. In order to enable manual emergency operation in the event of a failure or a shutdown of the compressed air supply, there is arranged in the two connection lines between the supply device and the chambers of the working cylinder a respective independently returning 3/2-way valve, which valves can be switched by means of a common control line which is connected downstream (that is to say, in the direction of the supply device) of the 3/2-way valves by means of a shuttle valve to both connection lines to the supply device. The 3/2-way valves connect the chambers in a first switching position to ventilation outlets and in a second switching position to the supply device, wherein they assume the first switching position in the idle position. The term "idle position" in the context of the disclosure is used to refer to the switching position which the 3/2-way valves assume as a result of their independent return when they are not acted on with a control pressure. Since the 3/2-way valves are connected by means of the common control line and a shuttle valve to both connection lines to the supply device, they are always acted on with pressure in both operating positions of the supply device at the control inputs thereof as long as the supply device provides a pressure via one of the two connection lines. In this instance, they are retained in the second switching position thereof in which they connect the chambers of the working cylinder of the supply device. The chambers of the dual-action working cylinder are according to the two operating positions of the supply device in each case acted on alternately (and the corresponding chamber is ventilated in each case by means of the supply device). If the compressed air supply provided by the supply device fails or is switched off, this also results in a loss of the control pressure at the control inputs of the two 3/2-way valves. The 3/2-way valves as a result of their independent return fall back into the idle position and consequently assume the first switching position, in which they connect the chambers of the working cylinder to ventilation outlets. Consequently, the dual-action working cylinder in this state is completely ventilated and a device which is driven thereby can be manually moved in both movement directions in a resistance-free manner. The manual capacity for emergency operation is ensured using purely pneumatic means and is independent of the existence of an electric power supply. The pneumatic control system at the same time makes provision according to the disclosure for there to be arranged upstream of the chambers in each case parallel circuits comprising non-return valves and throttle locations whose non-return valves block in the return flow direction. The two parallel circuits each have the function of an exhaust air throttle, as known in principle, for example, from DE 10 2008 011 315 A1. When pressure is applied to a connection line by the supply device, the respective non-return valve opens and affords access to the respective chamber of the working cylinder over the full cross-section of the connection line. In the return flow direction, that is to say, when the respective chamber is compressed, the non-return valve blocks, for which reason the exhaust air from the chamber can escape only via the reduced throttle cross-section of the throttle location in the direction of the supply device. There is thereby produced above the throttle location a counter-pressure which counteracts the piston movement. The piston stroke is braked, whereby a sudden movement of the device driven by the working cylinder, for example, a sudden opening and closing of connected vehicle doors, is prevented. However, in contrast to DE 10 2008 011 315 A1, the exhaust air throttle in this embodiment does not impede the manual emergency operation. With the parallel circuits not being arranged directly upstream of the chambers of the working cylinder, but instead being arranged in the connection lines in the exhaust air direction only downstream of the 3/2-way valves, the air which is urged out of the chambers by the piston movement in the event of a failure or a shutdown of the compressed air supply can escape via the ventilation outlets of the 3/2-way valves which are then located in the idle position over the full cross-section of the connection line. The disclosure has recognized that with the control system set out a pneumatic control system for a dual-action working cylinder with an exhaust air throttle is provided, in which in a simple manner an independent, resistance-free manual capacity for emergency operation using purely pneumatic means is enabled.

In order to regulate the damping action of the exhaust air throttle, the throttle locations are each formed with an adjustable throttle.

The independent return of the 3/2-way valves is achieved in a structurally simple manner by being pretensioned in a spring-loaded manner into the idle position.

In a compact construction, the controllable supply device is formed with the required properties by a pre-controlled 5/2-way valve. The 5/2-way valve has in this instance two working connections for connection to the two connection lines to the two chambers of the dual-action working cylinder and a compressed air connection for acting alternately on the working connections in the two operating positions and two compressed air outlets for connecting the working connection which is not being acted on in each case to the atmosphere for ventilation.

In an alternative embodiment, the controllable supply device is formed from two pre-controlled 3/2-way valves which each have a working connection for connection to a connection line, a compressed air connection and a compressed air outlet and which are precontrolled as a common device in such a synchronous manner that alternately in two switching positions one chamber of the dual-action working cylinder can be connected to a compressed air source and at the same time the other chamber can be connected to a compressed air outlet.

In the above embodiments, the damping which is brought about by the parallel circuits during operation acts in each case over the entire piston movement. The damping may, however, also be constructed only as an end position damping by the chamber which is opposite the chamber which is acted on with pressure in each case being ventilated additionally in an initial portion of the piston path by means of an additional opening, line or other outlet. This may, for example, be constructed as an end position damping which is integrated in the working cylinder by the piston of the working cylinder or a damping attachment which is constructed with the piston in the end position portions sealing additional ventilation channels which are arranged in the chambers of the working cylinder and which are connected to the atmosphere, as known, for instance, from DE 33 45 631 A1.

In a particularly compact embodiment of the pneumatic control system with an integrated end position damping, both chambers are constructed with additional ventilation openings which are each radially arranged at the beginning of an end portion of the piston path and which connect the chambers in each case via ventilation lines to non-return valves downstream of the parallel circuit to the connection lines which are associated therewith. In this instance, the respective compressed chamber is in each case ventilated via an initial portion of the compression movement of the piston in addition to ventilation via the throttle location by means of the ventilation opening. As soon as the piston moves over the ventilation opening when it reaches its position, it seals it at the peripheral side. From reaching this position, the chamber which is compressed in each instance in the remaining end portion of the piston movement is ventilated only via the throttle location, which damps the piston movement until it reaches the end position. The length of the throttle path can be determined in this instance in a structurally simple manner by means of the axial position of the ventilation openings on the working path of the piston. In the return flow direction, that is to say, when the respective supply line is acted on, the non-return valves block in each case.

BRIEF DESCRIPTION OF THE DRAWING

Advantageous developments of the disclosure will be appreciated below from the description of a preferred embodiment of the disclosure illustrated with reference to the FIGURE, in which:

FIG. 1 is a schematic circuit diagram of a pneumatic control system according to the disclosure.

DETAILED DESCRIPTION

According to FIG. 1, a pneumatic control system according to the disclosure has a pneumatic drive which is constructed as a dual-action working cylinder 1. The dual-action working cylinder 1 serves to open and close a vehicle door which is not illustrated in FIG. 1 by means of the movement of the piston 2. The two chambers 3 and 4 of the working cylinder 1 are connected by means of connection lines 5 and 6 to the supply device which is constructed as an electromagnetically precontrolled 5/2-way valve 7. The 5/2-way valve is precontrolled by means of the electromagnetic precontrol device 8 and has two working connections 9, 9' for connecting to the two connection lines 5 and 6 to the two chambers 3 and 4 of the dual-action working cylinder 1, and a compressed air connection 10 and two compressed air outlets 11 and 11' (exhaust air outlets). The 5/2-way valve 8 is pretensioned in according to the illustration of FIG. 1 with a resilient device 12 in a spring-loaded manner in a first operating position which is referred to as an idle position and in which the connection line 6 is connected to the compressed air connection 10. In the two connection lines 5 and 6, there are arranged upstream of the chambers 3 and 4, downstream in each case, 3/2-way valves 13 and 13' which can be switched with a control pressure. The two 3/2-way valves 13 and 13' each have a first connection 14 and 14' for connecting to the chambers 3, 4 and a second connection 15, 15' for connecting to the working connections 9, 9' of the 5/2-way valve 7. Furthermore, 3/2-way valves 13 and 13' have ventilation outlets 16, 16'. The precontrol of the 3/2-way valves 13 and 13' is carried out by means of the control connections 17, 17' and the common control line 18. The control line 18 draws the control pressure via the shuttle valve 19 and the connection lines 5, 6 downstream of the 3/2-way valves 13 and 13' from the working connections 9, 9' of the 5/2-way valve 7. The 3/2-way valves 13 and 13' have two switching positions, wherein they are pretensioned in accordance with the illustration of FIG. 1 in each case by means of a resilient device 20, 20' in a spring-loaded manner into a first switching position which is referred as the idle position and in which the chambers 3 and 4 of the working cylinder 1 are connected to the ventilation outlets 16 and 16'. In the connection lines 5, 6, there are arranged downstream of the 3/2-way valves 13 and 13' and upstream (that is to say, in the direction of the chambers 3, 4) of the branches of the connection line portions 5*a*, 6*a* to the shuttle valve 19 in each case parallel circuits comprising non-return valves 21, 21' and adjustable throttle locations 22, 22' whose non-return valves 21, 21' block in the return flow direction—that is to say, downstream. The chambers 3, 4 are constructed with ventilation openings 23, 23' which are arranged radially in each case at the beginning of an end portion of the piston path and which connect the chambers 3, 4 in each case via ventilation lines 24, 24' to non-return valves 25, 25' downstream of the parallel circuit to the portions 5*a*, 6*a* of the connection lines 5, 6. The compressed air connection 10 the 5/2-way valve 7 can be connected by means of the hand-operable emergency tap 26 manually either via the working connection 27 to the compressed air connection 28 (which is connected to a compressed air source which is not illustrated in FIG. 1) or the ventilation connection 29.

The pneumatic control system illustrated in FIG. 1 operates when acted on with compressed air as follows: the emergency tap 26 is open, wherein it is connected via the compressed air connection 10 via the working connection 27 and the compressed air connection 28 of the emergency tap 26 to a compressed air source. If the 5/2-way valve 7, in accordance with the illustration in FIG. 1, is in the first operating position thereof which is at the same time an idle position, the compressed air connection 10 is connected to the working connection 9'. Via the connection line 6, the shuttle valve 19 and the non-return valve 21' are acted on in a parallel manner. The shuttle valve 19 opens as a result of the application of pressure via the branch 6*a* of the connection line 6, whereby the control line 18 is acted on and both 3/2-way valves 13 and 13' are moved via the control connections 17, 17' from the first switching position (the pretensioned idle position) counter to the pretensionings of the resilient devices 20, 20' into their second switching position in each case. In this second switching position, the first connections 14 and 14' are connected to the second connections 15, 15'. Via the connection line 6, the non-return valve 21' opens as a result of the application of pressure. Via the opened 3/2-way valve 13', the chamber 4 of the working cylinder is acted on with pressure (aerated). The piston 2 thereby moves from the chamber 4 in the direction of the chamber 3 and a vehicle door driven by the working cylinder 1 opens. The chamber 3 is ventilated in an initial portion of the movement of the piston 2 via the ventilation opening 23, the ventilation line 24, the connection line portion 5*a*, the connection line 5, the working connection 9 and the compressed air outlet 11 which is connected thereto in the first operating position of the 5/2-way valve, wherein the non-return valve 25 opens as a result of the action of pressure. At the same time, the chamber 3 in this portion of the movement of the piston is also ventilated to a smaller extent via the control line 5 and the opened 3/2-way valve 13, wherein the non-return valve 24 blocks and air is discharged via the throttle location 22 and into the connection line 5 at the working connection 9. As soon as the piston 2 moves over the ventilation opening 23 which is arranged at the beginning of the end portion of the movement thereof, it seals it at the peripheral side so that air can no longer escape from the chamber 3 via the ventilation opening 23. From this point of the movement of the piston 2, the chamber 3 is exclusively ventilated via the control line 5, the opened 3/2-way valve 13 and the throttle location 22. As a result of the delayed emptying via the narrowed cross-section of the throttle location 22, the pressure in the chamber 3 acts as a counter-pressure, which damps the movement of the piston in the end position portion and consequently the opening movement of the vehicle door.

If the 5/2-way valve 7 is moved by the electromagnetic precontrol device 8 counter to the pretensionings of the resilient device 12 into the second operating position thereof, the compressed air connection 10 is connected to the working connection 9. Via the connection line 5, the shuttle valve 19 and the non-return valve 21 are acted on in parallel. The shuttle valve 19 opens as a result of the application of pressure via the portion 5*a* of the connection line 5 in the opposite direction, whereby the control line 18 is acted on via the connection line 5, 5*a* and both 3/2-way valves 13 and 13' are moved via the control connections 17, 17' counter to the pretensionings of the resilient devices 20, 20' into the second switching position thereof in each case. The chamber 3 of the working cylinder 1 is acted on with pressure (aerated) via the open 3/2-way valve 13 and the connection line 5. The piston 2 thereby moves from the chamber 3 in the direction of the chamber 4 and a vehicle door driven by the working cylinder 1 closes. The chamber 4 is in an initial portion of the movement of the piston ventilated via the ventilation opening 23', the ventilation line 24', the connection line portion 6*a*, the connection line 6, the working connection 9' and the compressed air output 11' connected thereto in the second operating position of the 5/2-way valve 7, wherein the non-return valve 25' opens as a result of the action of pressure. At the same time, the chamber 4 in this portion of the movement of the piston is also ventilated to a lesser extent via the control line 6 and the opened 3/2-way valve 13', wherein the non-return valve 21' blocks and air is discharged via the throttle location 22' into the connection line 6 at the working connection 9'. As soon as the piston 2 moves over the ventilation opening 23' which is arranged at the beginning of the end portion of the movement thereof, it seals it at the peripheral side so that air can no longer escape from the chamber 5 via the ventilation opening 23'. From this point of the movement of the piston 2, the chamber 4 is exclusively ventilated via the control line 6, the opened 3/2-way valve 13' and the throttle location 22'. As a result of the delayed emptying via the narrowed cross-section of the throttle location 22', the pressure in the chamber 4 acts as a counter-pressure which damps the movement of the piston 2 in the end position portion and consequently the closure movement of the vehicle door.

The sealing action of the piston 2 with respect to the ventilation openings 23 and 23' is improved by it being constructed at both ends thereof with seals, for example, sealing rings which are arranged at the peripheral side.

The illustration of FIG. 1 shows the pneumatic control in the ventilation position thereof in which the vehicle door driven by the working cylinder 1 can be moved (opened or closed) manually in a resistance-free manner. Via the compressed air connection 10, no air pressure is provided since it is switched off via the emergency tap 26 by the compressed air connection 10 being connected via the working connection 27 to the ventilation connection 29 of the emergency tap 26. In this position, regardless of the operating position of the 5/2-way valve via the working connections 9 and/or 9', no air pressure is provided. The control line 18 and the control connections 17, 17' of the 3/2-way valves 13 and 13' are thereby also not acted on with pressure. The 3/2-way valves 13 and 13' are located as a result of the pretensionings of the resilient devices 20, 20' in the first switching position thereof, the idle position. In this first switching position, the first connections 14 and 14' of the 3/2-way valves 13 and 13' are in each case connected to the ventilation outlets 16, 16'. Both chambers 3, 4 of the working cylinder 1 are completely ventilated via the ventilation outlets 16, 16' without the air which is urged during the movement having to pass the cross-section narrowings of the throttle locations 22, 22' since these are arranged only downstream of the 3/2-way valves 13, 13'. The piston 2 can be moved in a resistance-free manner from the chamber 4 in the direction of the chamber 3 or in the opposing direction and the vehicle door can be readily opened or closed. The same behavior is seen in the event of a failure of the compressed air supply regardless of the position of the emergency tap 26.

LIST OF REFERENCE NUMERALS

1 Working cylinder
2 Piston
3, 4 Chamber
5, 6 Connection line
5*a*, 6*a* Connection line portion
7 5/2-way valve
8 Precontrol device
9, 9', 27 Working connection
10, 28 Compressed air connection
11, 11' Compressed air outlet
12, 20, 20' Resilient device
13, 13' 3/2-way valves
14, 14' First connection
15, 15' Second connection
16, 16' Ventilation outlet
17, 17' Control connection
18 Control line
19 Shuttle valve
21, 21', 25, 25' Non-return valve
22, 22' Throttle location
23, 23' Ventilation opening
24, 24' Ventilation line
26 Emergency tap
29 Ventilation connection

The invention claimed is:

1. A pneumatic control system with a dual-action working cylinder whose two chambers can be connected by means of a controllable supply device having two operating positions in an opposing manner to a compressed air source and a compressed air outlet, and there is arranged upstream of each chamber in a connection line to the supply device in each case an independently returning 3/2-way valve which can be switched with a control pressure, which valves connect the chambers in a first switching position to ventilation outlets and connect them in a second switching position to the supply device, and there is arranged upstream of each chamber a parallel circuit comprising a non-return valve and a throttle location whose non-return valves block in the return flow direction, wherein the two 3/2-way valves in the idle position assume the first switching position and can be switched by means of a common control line which is connected downstream of the 3/2-way valves by means of a shuttle valve to both connection lines to the supply device and the parallel circuits are arranged in the connection lines in each case downstream of the 3/2-way valves.

2. The pneumatic control system as claimed in claim 1, wherein the throttle locations are each formed with an adjustable throttle.

3. The pneumatic control system as claimed in claim 1, wherein the 3/2-way valves are pretensioned in a spring-loaded manner into the idle position.

4. The pneumatic control system as claimed in claim 1, wherein that the supply device is formed by a precontrolled 5/2-way valve.

5. The pneumatic control system as claimed in claim 1, wherein the supply device is formed from two pre-controlled 3/2-way valves which are each associated with a chamber.

6. The pneumatic control system as claimed in claim 1, wherein the chamber which is opposite the chamber which is acted on with pressure in each case is ventilated in an initial portion of the piston path additionally via an additional opening, line or additional outlet.

7. The pneumatic control system as claimed in claim 1, wherein both chambers are constructed with additional ventilation openings which are each radially arranged at the beginning of an end portion of the piston path and which connect the chambers in each case via ventilation lines to non-return valves downstream of the parallel circuit to the connection lines (5, 6) which are associated therewith.

* * * * *